US008181377B2

(12) United States Patent
Lofgren et al.

(10) Patent No.: US 8,181,377 B2
(45) Date of Patent: May 22, 2012

(54) DISPLAY DEVICES AND METHODS OF DISPLAYING OBJECTS

(75) Inventors: Jason C. Lofgren, Chicago, IL (US); Matthew D. LeRoy, Chicago, IL (US)

(73) Assignee: ADE, Inc., Chicago, IL (US)

( * ) Notice: Subject to any disclaimer, the term of this patent is extended or adjusted under 35 U.S.C. 154(b) by 80 days.

(21) Appl. No.: 12/657,554

(22) Filed: Jan. 22, 2010

(65) Prior Publication Data

US 2010/0326019 A1 Dec. 30, 2010

Related U.S. Application Data

(60) Provisional application No. 61/269,874, filed on Jun. 29, 2009.

(51) Int. Cl.
*A47G 1/06* (2006.01)

(52) U.S. Cl. ..... 40/800; 40/734; 40/743; 40/771; 206/484

(58) Field of Classification Search ..... 40/700, 40/722, 723, 724, 734, 740, 743, 771, 772, 40/800; 206/0.8, 0.82, 484, 466, 777, 778
See application file for complete search history.

(56) References Cited

U.S. PATENT DOCUMENTS 1,448,664 A * 3/1923 Hull ..... 40/493
2,416,976 A * 3/1947 Barbieri ..... 40/734
2,515,053 A * 7/1950 Nesel ..... 40/734
3,193,090 A * 7/1965 Hudgeons, Sr. et al. ..... 206/0.83
3,804,360 A 4/1974 Stecker
4,125,655 A 11/1978 Kanzelberger
4,466,534 A * 8/1984 Dunn ..... 206/777
4,852,743 A * 8/1989 Ridgeway ..... 206/583
5,057,344 A * 10/1991 Mealey ..... 428/13
5,407,711 A 4/1995 Lovison et al.
5,762,200 A * 6/1998 Goudreau ..... 206/583
5,769,235 A 6/1998 Keach et al.
5,863,414 A * 1/1999 Tilton ..... 206/470
5,988,387 A 11/1999 Staal et al.
6,025,040 A * 2/2000 Brockley ..... 428/14
6,112,445 A * 9/2000 Feeney ..... 40/747
6,193,057 B1 * 2/2001 Cappiello, Sr. ..... 206/6.1
6,322,862 B1 11/2001 Sakai (Continued)

OTHER PUBLICATIONS

"Thermoplastic Elastomers," http://pslc.ws/macrog/exp/rubber/sepisode/tpe.htm, Dec. 31, 2000.*

(Continued)

*Primary Examiner* — Gary Hoge
(74) *Attorney, Agent, or Firm* — Cook Alex Ltd.

(57) ABSTRACT

A display device includes (a) a first mounting member containing a first film-mounting surface, wherein the first film-mounting surface demarcates a first opening in the first mounting member; (b) a second mounting member containing a second film-mounting surface, wherein the second film-mounting surface demarcates a second opening in the second mounting member; (c) a first elastomeric film mounted to the first film-mounting surface and extending across the first opening; (d) a second elastomeric film mounted to the second film-mounting surface and extending across the second opening; and (e) a chassis configured for supporting the first mounting member and the second mounting member. The first opening and the second opening are configured for oppositional alignment in the chassis, and the first elastomeric film and the second elastomeric film are configured to retain a display object in a region defined by an oppositional alignment of the first opening and the second opening.

25 Claims, 4 Drawing Sheets

U.S. PATENT DOCUMENTS

| | | | | |
|---|---|---|---|---|
| 6,817,125 | B2 | 11/2004 | Chatterjea | |
| 7,146,759 | B2 * | 12/2006 | Bell | 40/734 |
| 7,437,846 | B2 * | 10/2008 | Franco et al. | 40/729 |
| 2004/0071898 | A1 | 4/2004 | Trabucco | |
| 2005/0025907 | A1 | 2/2005 | Stepka | |
| 2005/0037156 | A1 | 2/2005 | Sohl et al. | |
| 2006/0042995 | A1 | 3/2006 | McGrath et al. | |
| 2006/0080879 | A1 * | 4/2006 | Parrington | 40/800 |
| 2007/0009748 | A1 | 1/2007 | Takanami et al. | |
| 2007/0044351 | A1 | 3/2007 | Currie | |

OTHER PUBLICATIONS

PCT International Search Report for PCT/US10/01252 dated Jun. 24, 2010 (3 pages).

Thirty Six Photographs of Lagos Jewelry Box, unknown date.

* cited by examiner

DISPLAY DEVICES AND METHODS OF DISPLAYING OBJECTS

RELATED APPLICATIONS

This application claims the benefit of U.S. Provisional Application No. 61/269,874, filed Jun. 29, 2009, the entire contents of which are hereby incorporated herein by reference.

TECHNICAL FIELD

The embodiments described herein relate generally to devices and methods for displaying objects—particularly, though not exclusively, for displaying three-dimensional objects.

INTRODUCTION

There has been a persistent and long-felt need within the framing industry for a better solution to the challenge of displaying three-dimensional objects efficiently, cost-effectively, and in aesthetically pleasing ways that facilitate viewing the three-dimensional objects from any desired perspective—not just from a single vantage point—while protecting the objects from soiling, oxidation, fading, ultraviolet degradation, and the like. This problem is particularly acute when the three-dimensional objects to be displayed constitute rare and/or one-of-a-kind memorabilia (e.g., sports memorabilia, trophies, precious coins, and the like), which have intrinsic and/or sentimental value to an owner.

One approach that has been adopted for the framing and display of three-dimensional objects is the use of shadow box framing. A typical shadow box is a frame that has a deeper than normal rabbet depth sufficient to accommodate the dimensions of the three-dimensional object. Typically, the three-dimensional object is mounted (e.g., to a surface at the back of the frame) and covered at the front of the frame by a transparent shield (e.g., glass, plastics such as that sold under the tradename PLEXIGLAS by Rohm and Haas or the like).

A significant drawback to the shadow box approach is the lack of economy in its structural design. For example, the shadow boxes themselves are generally much bulkier than conventional frames of the type adapted for display of two-dimensional objects (e.g., prints, photographs, and the like) and, for that matter, are much larger than the display objects themselves. Moreover, if a shadow box is to be wall-mounted, a further drawback is that the shadow box extends from the wall by a significantly larger distance than would a typical frame, which makes the shadow box highly susceptible to inadvertent jostling, displacement, and/or damage from passersby. Furthermore, in view of the infinite variability in the shapes and dimensions of three-dimensional objects for which display is sought, shadow box framing typically requires custom design and manufacture by experienced framing professionals according to the unique dimensions of a particular object to be displayed, thereby posing significant expense to consumers who generally lack the requisite skills to construct a shadow box to meet their specific needs.

In addition, since at least one surface of the three-dimensional object is typically mounted to a surface in the shadow box (most typically a rear surface), the available perspectives from which the object can be view and enjoyed is of necessity diminished, with a rear-view of the object being essentially eliminated. Furthermore, if the object is to be protected behind a transparent protective glass or plastic shield at the front of the shadow box—which is generally desirable to preserve the condition and integrity of the object—there is an aesthetic barrier imposed between the object and the viewer, which prevents any type of contact with the object.

The inability to view a three-dimensional object from all of its perspectives inherent in shadow box framing is also encountered in several other framing approaches that have been proposed within the industry. By way of example, the golf ball display described in U.S. Pat. No. 6,025,040 to James L. Brockley (e.g., see FIG. 1 thereof), and the bouquet frame described in U.S. Pat. No. 5,057,344 to Margaret P. Mealey (e.g., see FIG. 2 thereof) are two approaches for displaying three-dimensional objects, neither of which provides a viewer with visual access to the rear of the object on display.

In short, devices and methods for displaying three-dimensional objects that afford visual access to an object from a full complement of viewing perspectives while safeguarding the state of preservation and integrity of the object under archival conservation conditions would be of tremendous benefit in solving the above-described long-felt need within the framing industry. Moreover, devices and methods having the requisite flexibility to extend to the display of both two- and three-dimensional objects would be particularly desirable.

SUMMARY

The scope of the present invention is defined solely by the appended claims, and is not affected to any degree by the statements within this summary.

By way of introduction, a display device includes (a) a first mounting member containing a first film-mounting surface, wherein the first film-mounting surface demarcates a first opening in the first mounting member; (b) a second mounting member containing a second film-mounting surface, wherein the second film-mounting surface demarcates a second opening in the second mounting member; (c) a first elastomeric film mounted to the first film-mounting surface and extending across the first opening; (d) a second elastomeric film mounted to the second film-mounting surface and extending across the second opening; and (e) a chassis configured for supporting the first mounting member and the second mounting member. The first opening and the second opening are configured for oppositional alignment in the chassis, and the first elastomeric film and the second elastomeric film are configured to retain a display object in a region defined by an oppositional alignment of the first opening and the second opening.

A second display device includes (a) a first mounting member containing a first film-mounting surface, wherein the first film-mounting surface demarcates a first opening in the first mounting member; (b) a second mounting member containing a second film-mounting surface, wherein the second film-mounting surface demarcates a second opening in the second mounting member; (c) a first elastomeric film mounted to the first film-mounting surface and extending across the first opening; (d) a second elastomeric film mounted to the second film-mounting surface and extending across the second opening; and (e) a chassis configured for supporting the first mounting member and the second mounting member, and further configured to pivot between an open position and a closed position. Each of the first and second elastomeric films contains polyurethane, and the first opening and the second opening are configured to be in substantial alignment when the first mounting member and the second mounting member are supported in the chassis and the chassis is in the closed position. The first elastomeric film and the second elastomeric film are configured to stretch to conform to a three-dimensional shape of a display object retained in a region defined by the alignment of the first opening and the second opening when the first mounting member and the second mounting member are supported in the chassis.

A method of displaying an object includes inserting an object between the first and second elastomeric films of a display device as described above.

DETAILED DESCRIPTION

Figure 1:
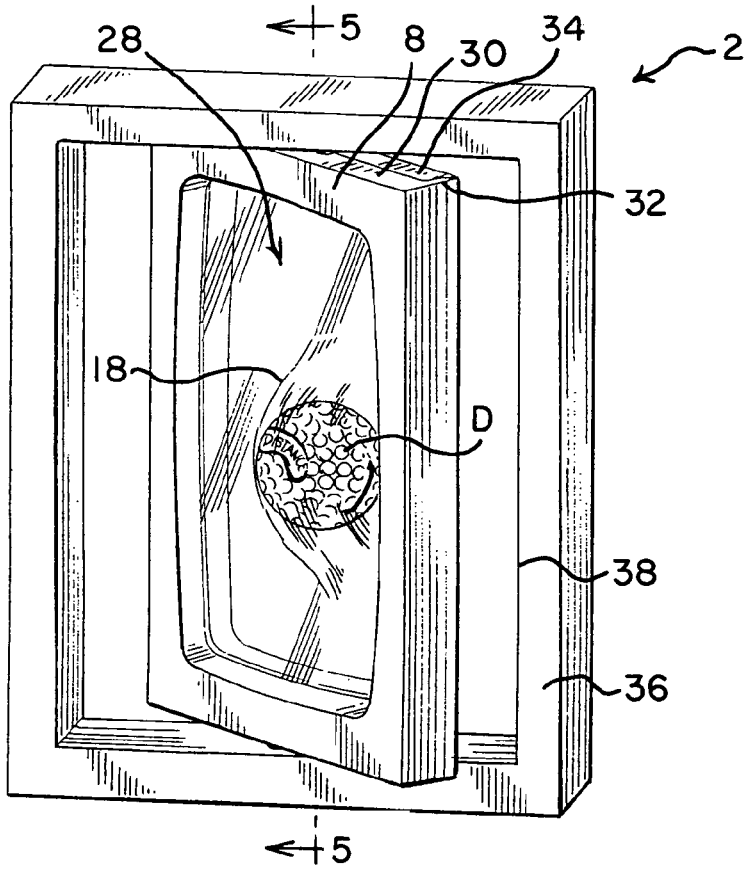
FIG. 1 shows a perspective view of a first display device displaying a representative three-dimensional object.

Devices with the capacity to display two- or three-dimensional objects in such a way as to provide visual access to an object from a full complement of viewing perspectives while safeguarding the state of preservation and integrity of the object have been discovered and are described hereinbelow. Methods for the use of such display devices are likewise described.

By way of introduction, devices described herein include a pair of elastomeric films which, as further explained below, are uniquely configured to retain a display object therebetween. In the case of two-dimensional display objects (e.g., prints, photographs, drawings, documents, and the like), the elastomeric films are configured to sandwich and securely retain the object without undergoing significant elastomeric deformation.

In the case of three-dimensional objects, the elastomeric films are further configured to stretch in order to snugly conform to the three-dimensional shape of the display object retained therebetween. By utilizing transparent and/or acid-free and/or UV-protected elastomeric films, it becomes possible to display an object in such a way that it is viewable from a full array of perspectives while the integrity and condition of the object are preserved in the face of damaging environmental effects. Moreover, since the elastomeric films are typically thin and flexible such that a snug close-fit with the object can be achieved, it is possible for a viewer to feel the texture and topography of the object (e.g., the stitching on an autographed baseball, the raised features on a coin, etc.) through the films without imparting any dirt and/or oily residues to the object, thereby enhancing the viewer's overall physical experience of the object.

As best shown by FIGS. 1, 3, 4, and 5, a first embodiment of a display device 2 includes a first mounting member 4, a second mounting member 6, and a chassis 8 configured for supporting first mounting member 4 and second mounting member 6. The first mounting member 4 comprises a first film-mounting surface 10, which demarcates a first opening 12 in first mounting member 4. The second mounting member 6 comprises a second film-mounting surface 14, which demarcates a second opening 16 in second mounting member 6.

Figure 4:
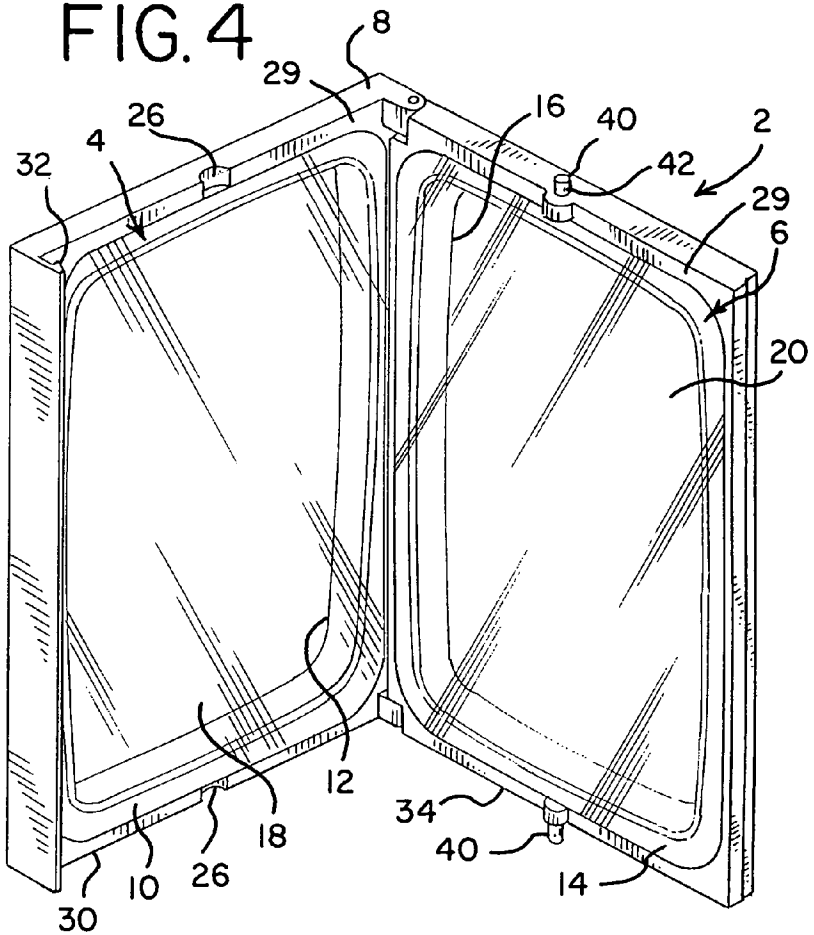
FIG. 4 shows a perspective view of the chassis of FIG. 1 in an open position.
Figure 3:
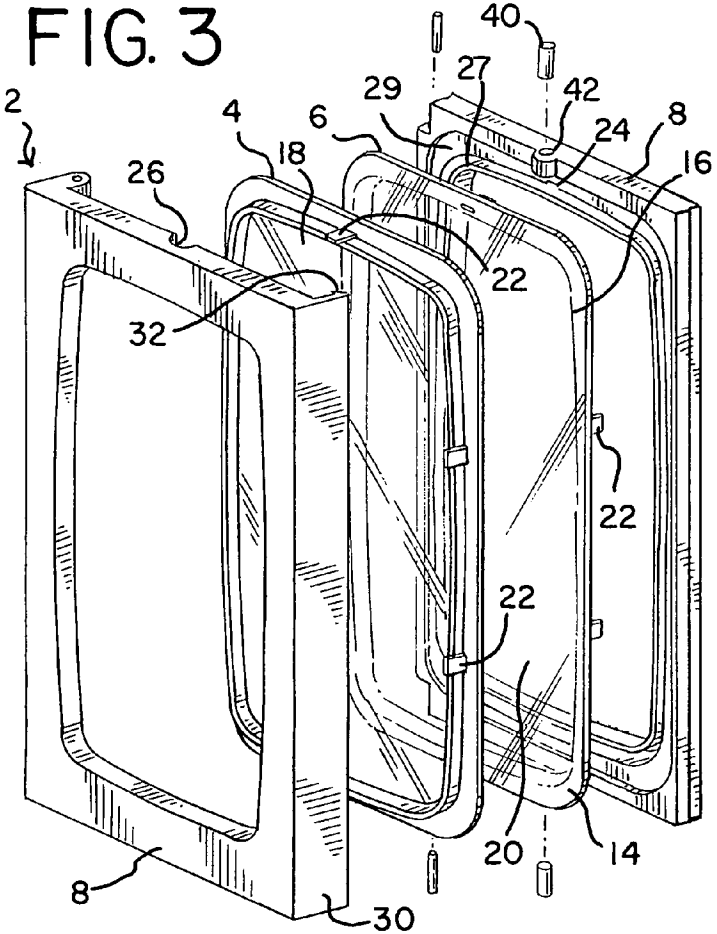
FIG. 3 shows an exploded perspective view of the chassis of the display device shown in FIG. 1.
Figure 5:
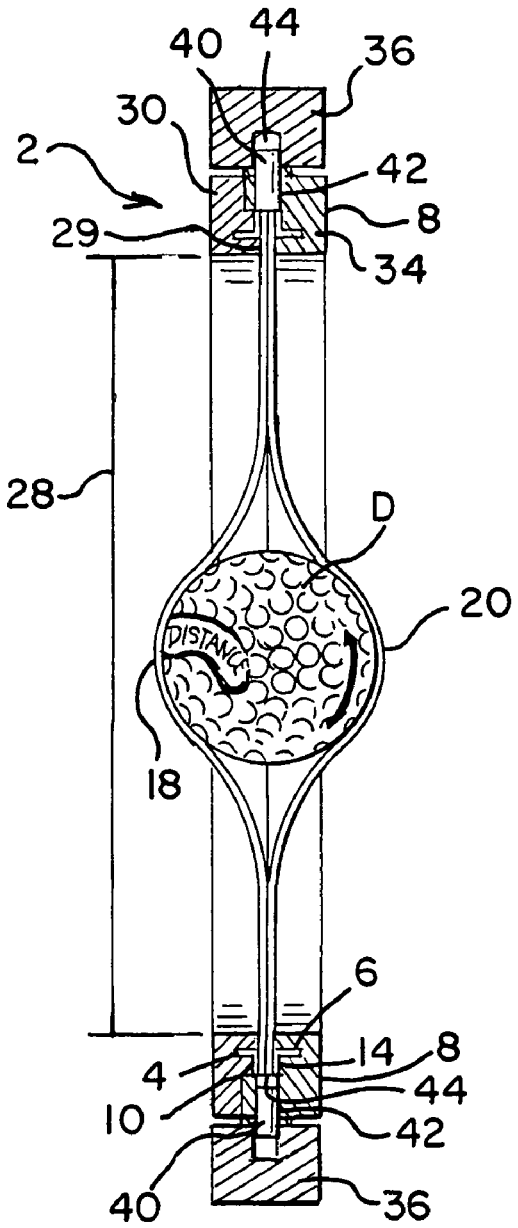
FIG. 5 shows a cross-sectional side view of the device of FIG. 1 taken along the line 5-5.

As best shown by FIGS. 3, 4, and 5, a first elastomeric film 18 is mounted to first film-mounting surface 10 and extends across first opening 12, and a second elastomeric film 20 is mounted to second film-mounting surface 14 and extends across second opening 16. First elastomeric film 18 and second elastomeric film 20 may be attached to first mounting member 4 and second mounting member 6, respectively, by any suitable means, including but not limited to by ultrasonic welding, adhesives, stapling, and the like, and combinations thereof.

Chassis 8 is configured to pivot between an open position, as shown in FIG. 4, and a closed position, as shown in FIGS. 1 and 5. Thus, first opening 12 and second opening 16 are configured for oppositional alignment within chassis 8, and are brought substantially into alignment when chassis 8 is brought to the closed position. As best shown by FIG. 4, first mounting member 4 and second mounting member 6 are respectively provided on opposing inner surfaces 29 of chassis 8. As used herein, the phrase "open position" is intended to encompass multiple positions within a selected range and refers to an open configuration of chassis 8 sufficient to allow insertion of a display object within. Thus, references herein to chassis 8 being in an "open position" are intended to encompass situations in which additional unfolding of chassis 8 beyond the minimum needed for object insertion is available.

In some embodiments, as best shown by FIGS. 3 and 4, first mounting member 4 and second mounting member 6 are detachable from chassis 8. In other embodiments, one or both of first mounting member 4 and second mounting member 6 are integrally formed in chassis 8 and, therefore, are not removable. In embodiments in which first mounting member 4 and second mounting member 6 are removable from chassis 8, first mounting member 4 can include one or a plurality of mounting legs 22 configured to be press-fit into complementary receiving wells 24 in chassis 8, as best shown by FIG. 3. Of course, other mechanisms for enabling an analogous type of friction fit can likewise be employed, including but not limited to the provision of a ledge surface extending around the entire perimeter of the mounting members (or some portion or portions thereof), which is configured to be received in a complementary groove in the chassis. In the embodiment shown in FIG. 3, removal of first and second mounting members 4 and 6 from chassis 8 can be achieved by applying a removing force at one or both of the depressions 26 provided along top and bottom internal edges of chassis 8.

As best shown by FIG. 3, a ridge 27 is provided in each of the opposing inner surfaces 29 of chassis 8 (although only one of these ridges is visible in the depiction shown in FIG. 3). Ridges 27 can be slightly higher than inner surfaces 29, and serve to conceal from view inner surfaces of first mounting member 4 and second mounting member 6, thereby conferring a floating effect, best shown in FIG. 4.

In embodiments in which first and second mounting members 4 and 6 are removable from chassis 8, their design and configuration can be analogous to those of the mounting rings described in U.S. Pat. No. 5,988,387 and U.S. Patent Application Publication No. 2006/0042995 A1, as well as to the support elements described in U.S. Pat. No. 5,769,235. The entire contents of all three of the above-identified patent documents—each of which is assigned to the assignee of the present invention—are incorporated herein by reference in their entireties, except that in the event of any inconsistent disclosure or definition from the present application, the disclosure or definition herein shall be deemed to prevail.

As best shown by FIGS. 1 and 5, first elastomeric film 18 and second elastomeric film 20 are configured to snugly retain a display object D (shown in these drawings as a golf ball strictly for purposes of illustration) in a region 28 defined by an oppositional alignment of first opening 12 and second opening 16. Moreover, as best shown by FIG. 5, first elastomeric film 18 and second elastomeric film 20 are configured to stretch to conform to the three-dimensional shape of the display object D retained in region 28. As can be appreciated from a consideration of FIGS. 1 and 5, a viewer can clearly observe the golf ball from a full complement of angles (e.g., top, bottom, front, and rear) and, if desired, experience the tactile feel of its three-dimensional, dimpled topography through first elastomeric film 18 and/or second elastomeric film 20.

In some embodiments, as best shown by FIG. 4, a first portion 30 of chassis 8 comprises a locking member 32 configured to releasably engage with a second portion 34 of chassis 8, such that in the closed position, as best shown by FIG. 1, first mounting member 4 and second mounting member 6 are retained in opposition to one another. In some embodiments, locking member 32 is provided along the side edge of chassis 8 configured for opening and closing (i.e., the edge opposite the hinged edge shown in FIG. 4).

In some embodiments, chassis 8 comprises a pedestal (not shown) configured to self-support display device 2 on a surface, and in some embodiments chassis 8 is pivotable on this pedestal.

In some embodiments, as best shown by FIG. 1, display device 2 further comprises a frame 36, which includes an opening 38 configured to receive at least a portion of chassis 8 therein. In the embodiment shown in FIG. 1, frame 36 is rectangular and, therefore, is geometrically configured to self-support itself upon a surface. In other embodiments, particularly those in which frame 36 has a geometric shape (e.g., circular) that lacks a sufficiently planar surface to enable its self-support, frame 36 can comprise a pedestal.

In some embodiments, as best shown by FIG. 1, chassis 8 is pivotally supported within frame 36. In some embodiments, such as that shown in FIG. 1, chassis 8 is pivotable longitudinally within frame 36. In other embodiments, chassis 8 is pivotable widthwise within frame 36. Such pivotable configurations can be achieved, for example by providing dowel pins 40 in one half of chassis 8, which can be press-fit into complementary pin sockets 42 in chassis 8 and in complementary receiving sockets 44 in frame 36, as best shown by FIGS. 3 and 5.

In the embodiment shown in FIGS. 1, 3, 4, and 5, each of chassis 8 and opening 38 of frame 36 are substantially rectangular in shape. It is to be understood, however, that these configurations are merely representative and that all manner of alternative regular and irregular geometric shapes can be employed for chassis 8 and/or opening 38.

In addition, in the embodiment shown in FIGS. 1, 3, 4, and 5, each of first opening 12 and second opening 16 is substantially rectangular in shape. It is to be understood, however, that these configurations are merely representative and that all manner of alternative regular and irregular geometric shapes can be employed for first opening 12 and second opening 16. Indeed, first opening 12 and second opening 16 may independently comprise any regular or irregular geometric shape, and the geometric shapes of first opening 12 and second opening 16 need not be the same although it is desirable in some embodiments that they be complementary. By way of example, with respect to potential alternative regular geometric shapes, one or both of first opening 12 and second opening 16 could be oval, square, triangular, circular, rhombic, deltoidal, pentagonal, hexagonal, pentagrammatic, trapezoidal, heart-shaped, or the like.

Figure 2:
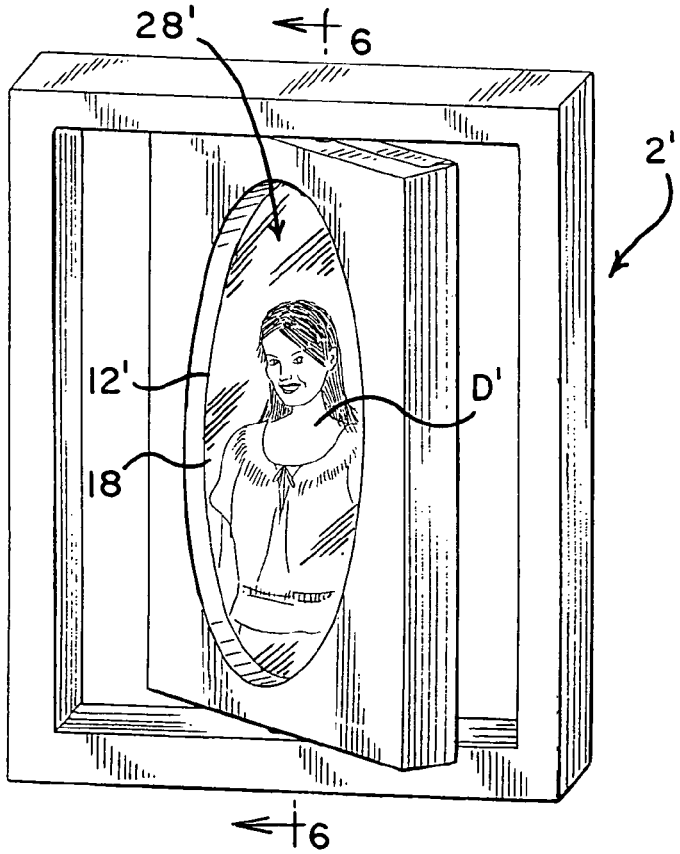
FIG. 2 shows a perspective view of a second display device displaying a representative two-dimensional object.
Figure 6:
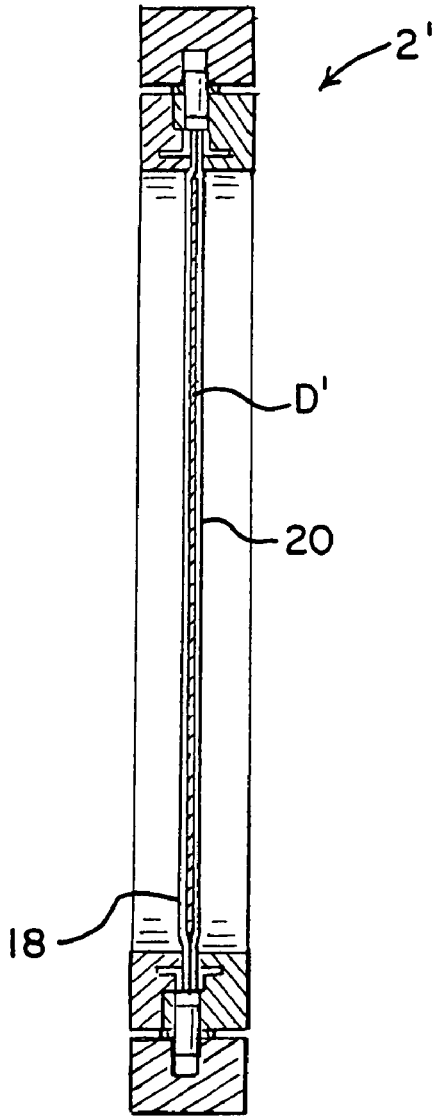
FIG. 6 shows a cross-sectional side view of the device of FIG. 2 taken along the line 6-6.

FIGS. 2 and 6 show a second embodiment of a display device 2', which is similar to display device 2 shown in FIGS. 1, 3, 4, and 5 except that first opening 12' and second opening 16' are oval rather than rectangular. In FIGS. 2 and 6, elements that are analogous though not identical to corresponding elements in FIGS. 1, 3, 4, and 5 have been identified through the use of prime marks following their reference characters. Although unrelated to the illustration of alternative geometric shapes for first opening 12' and second opening 16' in FIGS. 2 and 6, these drawings also differ from FIGS. 1, 3, 4, and 5 in their depiction of a two-dimensional display object D' rather than a three-dimensional object D. As best shown by FIG. 6, first elastomeric film 18 and second elastomeric film 20 snugly retain two-dimensional display object D' (shown in these drawings as a photograph strictly for purposes of illustration) in a region 28' defined by an oppositional alignment of first opening 12' and second opening 16'. Moreover, as best shown by FIG. 6, first elastomeric film 18 and second elastomeric film 20 are not required to stretch or deform in order to conform to the flat shape of display object D'. Thus, as can be appreciated, the display devices 2 and 2' shown in FIGS. 1-6 can be adapted for use with two- or three-dimensional display objects without necessitating any changes whatsoever to their structural design—a measure of flexibility that has been heretofore unachievable using conventional framing strategies.

First elastomeric film 18 and second elastomeric film 20 may be formed from any suitable elastomeric material that exhibits some degree of stretchability and, optionally, memory (i.e., a tendency to return to an original shape following deformation), including but not limited to polymeric materials, rubber, spandex cloth, and the like. In some embodiments, the elastomeric material comprises a polymeric material, and in some embodiments, the polymeric material comprises polyurethane, polyethylene or the like, and combinations thereof. In some embodiments, first elastomeric film 18 and second elastomeric film 20 comprise polyurethane. All manner of widths, thicknesses, and the like of elastomeric materials are contemplated for use in accordance with first elastomeric film 18 and second elastomeric film 20.

In some embodiments, the elastomeric material (e.g., polyurethane) used to form first elastomeric film 18 and second elastomeric film 20 is substantially transparent, which is desirable when unhindered visual access to a display object from an array of perspectives is being sought. However, in other embodiments, one or both of first elastomeric film 18 and second elastomeric film 20 can be tinted in whole or in part, and can optionally contain printed text and/or images designed to enhance the aesthetic impact of an object on display.

In some embodiments, the polymeric material used to form first elastomeric film 18 and/or second elastomeric film 20 can include one or more additives—particularly though not exclusively ones designed to assist in the archival conservation of an object on display—as will be well-understood by those of ordinary skill in the art. Representative additives include but are not limited to ultraviolet light absorbing agents, antimicrobials, antifungals, antioxidants, anti-static agents, deacidification agents, plasticizers, and the like, and combinations thereof.

As explained above, the display devices described herein are equally well-suited for use with two- or three-dimensional display objects. However, when a display device is used to accommodate a three-dimensional display object, such as display object D shown in FIGS. 1 and 5, the stretching experienced by first elastomeric film 18 and second elastomeric film 20 may not be completely reversed upon removal of display object D. Accordingly, in such instances, it may be desirable to replace first elastomeric film 18 and second elastomeric film 20. Moreover, after long periods of display, first elastomeric film 18 and/or second elastomeric film 20 may eventually begin to exhibit some degree of sagging and/or wrinkling, thereby indicating that a replacement of first elastomeric film 18 and/or second elastomeric film 20 is desirable.

In embodiments in which first and second mounting members 4 and 6 are removable from chassis 8, a facile way to refresh first elastomeric film 18 and second elastomeric film 20 is to install new first and second mounting members 4 and 6 that contain, respectively, new first and second elastomeric films 18 and 20. Alternatively—and in embodiments in which first and second mounting members 4 and 6 are integrally formed in chassis 8—the fatigued first and second elastomeric films 18 and 20 can be removed from their respective first and second film-mounting surfaces 10 and 14 and new ones installed in their place.

It is to be understood that numerous changes and modifications can be made to the various embodiments described herein, as will be well appreciated by those skilled in the art. For example, while FIGS. 1-6 depict a chassis 8 configured to pivot between an open position and a closed position with first and second mounting members 4 and 6 provided on opposing inner surfaces 29 of chassis 8, simplified configurations could likewise be implemented including but not limited to one in which the mounting members are slidably received in complementary grooves in a chassis that is not configured to open or close.

Figure 7A:
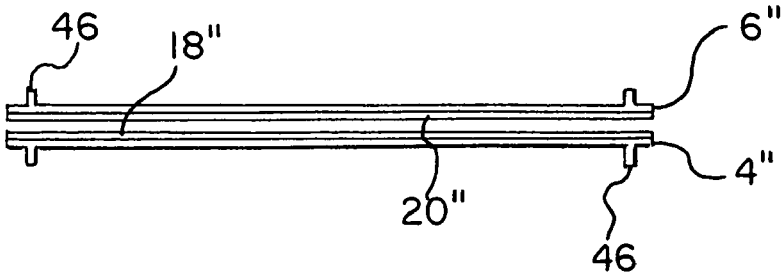
FIG. 7A shows a top plan view of first and second mounting members positioned in opposing alignment to one another and having a first configuration for securing the mounting members within a chassis.
Figure 7B:
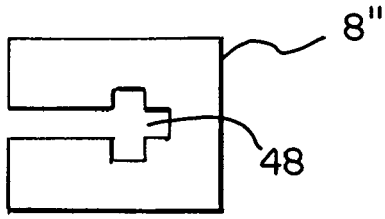
FIG. 7B shows a top plan view of a corner of a chassis configured to receive the first and second mounting members shown in FIG. 7A.

By way of illustration, as shown in FIG. 7A, first mounting member 4" and second mounting member 6" could be free-standing elements configured to sandwich a display object (not shown) between first elastomeric film 18" and second elastomeric film 20" and then be compressed together by a user in preparation to be inserted into a chassis. As shown in FIG. 7A, first mounting member 4" and second mounting member 6" contain grooves 46 along the side portions thereof, which are configured to be slidably received in complementary depressions in a chassis. FIG. 7B depicts a top plan view in detail of one corner of a chassis 8" containing a T-shaped channel 48 configured to slidably receive the grooves 46 of first mounting member 4" and second mounting member 6" in their compressed face-to-face relationship. In FIGS. 7A and 7B, elements that are analogous though not identical to corresponding elements in FIGS. 1-6 have been identified through the use of double prime marks following their reference characters.

Figure 8A:
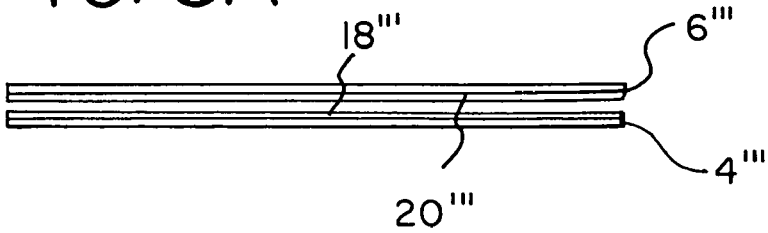
FIG. 8A shows a top plan view of first and second mounting members positioned in opposing alignment to one another and having a second configuration for securing the mounting members within a chassis.
Figure 8B:
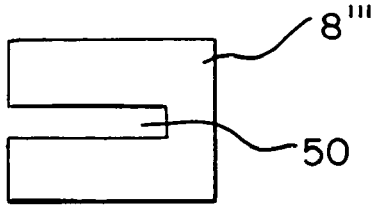
FIG. 8B shows a top plan view of a corner of a chassis configured to receive the first and second mounting members shown in FIG. 8A.

In an even more simplified alternative configuration, as shown in FIG. 8A, first mounting member 4" and second mounting member 6" could be free-standing elements configured to sandwich a display object (not shown) between first elastomeric film 18" and second elastomeric film 20" and then be compressed together by a user in preparation to be inserted into a chassis. Unlike the first and second mounting members 4" and 6" shown in FIG. 7A, the first and second mounting members 4" and 6" shown in FIG. 8A are not provided with any grooves along the side edges thereof. Rather, first and second mounting members 4" and 6" have smooth rear surfaces (i.e., the surfaces opposite the sides on which first and second elastomeric films 18'" and 20'" are attached), and are configured to be slidably received in complementary depressions in a chassis. FIG. 8B depicts a top plan view in detail of one corner of a chassis 8" containing a U-shaped channel 50 configured to slidably receive first mounting member 4' and second mounting member 6" in their compressed face-to-face relationship. In FIGS. 8A and 8B, elements that are analogous though not identical to corresponding elements in FIGS. 1-6 have been identified through the use of triple prime marks following their reference characters.

All manner of sizes and dimensions are contemplated for the various elements of the display devices described herein. The sizes, dimensions, and shapes of these elements are not restricted and—as will be well appreciated by those skilled in the art—the specific dimensions of a device and its various elements may be determined in view of the size and/or shape of an object to be displayed. In view of the stretchability of the elastomeric films described herein, one size of device will generally be able to accommodate a plurality of differently sized and/or differently shaped objects, provided the region defined by the alignment of the first and second openings in the first and second mounting members, respectively, is sufficiently large to accommodate the differently sized and/or differently shaped objects.

For smaller dimensioned and/or lighter display objects, the display devices described herein can be designed to be supported on a shelf or other substantially flat surface (e.g., with or without pedestals as described above). For larger dimensioned and/or heavier display objects, the display devices can be designed to stand on the floor (e.g., with or without pedestals as described above).

The first and second mounting members 4 and 6, chassis 8, frame 36, and other structural elements of the display devices described herein may be formed from all manner of materials and combinations of materials, including but not limited to steel, wood, polymeric materials (e.g., plastics), glass, metals (e.g., gold, silver, copper, iron), metal oxides, metal alloys (e.g., brass, bronze), and the like, and combinations thereof. First and second elastomeric films 18 and 20, however, are desirably formed from materials such as those described above. In some embodiments, all portions of the display device can be formed from the same material. In other embodiments, different materials can be used for different elements of the display device.

The type of object to be displayed in a display device of a type described herein is in now way restricted and includes objects having intrinsic and/or sentimental value to an owner. Representative objects include but are not limited to sport objects (e.g., baseballs, footballs, golf balls, golf tees, hockey pucks, etc.); ephemera (e.g., sports cards, photographs, prints, documents, ticket stubs, drawings, posters, etc.); collectors plates; medals and/or ribbons (e.g., military medals, military ribbons, Olympic medals, etc.); articles of clothing (e.g., T-shirts, gloves, hats, etc.); coins and/or paper currency; musical paraphernalia (e.g., guitar picks, harmonicas, drumsticks, etc.); trophies (e.g., sporting trophies, Emmy® statuettes, Oscar® statuettes, etc.); porcelain objects (e.g., Hummel figurines, coffee mugs, ashtrays, etc.); scaled models (e.g., automobiles, etc.); and the like; and combinations thereof. Moreover, it is to be understood that all of the above-described representative objects to be displayed may optionally be autographed.

A method of displaying an object in accordance with the present teachings includes (a) inserting an object between the first and second elastomeric films of a display device of a type described herein (e.g., while the chassis is in an open position); and (b) closing the chassis, such that a display object is retained in the region defined by the alignment of the first opening and the second opening in the first mounting member and second mounting member, respectively. Additionally, in embodiments in which the chassis includes a locking member, the method further includes (c) engaging the locking member on the first edge of the chassis with the second edge of the chassis, such that the chassis is releasably locked in the closed position.

The foregoing detailed description and accompanying drawings have been provided by way of explanation and illustration, and are not intended to limit the scope of the appended claims. Many variations in the presently preferred embodiments illustrated herein will be apparent to one of ordinary skill in the art, and remain within the scope of the appended claims and their equivalents.

The invention claimed is:

1. A display device comprising:

a first mounting member comprising a first film-mounting surface, wherein the first film-mounting surface demarcates a first opening in the first mounting member;

a second mounting member comprising a second film-mounting surface, wherein the second film-mounting surface demarcates a second opening in the second mounting member;

a first elastomeric film mounted to the first film-mounting surface and extending across the first opening;

a second elastomeric film mounted to the second film-mounting surface and extending across the second opening; and a chassis configured for supporting the first mounting member and the second mounting member on opposing first and second inner surfaces of the chassis, the first mounting member includes at least one mounting leg configured to be press-fit within at least one receiving well on the first inner surface and the second mounting member includes at least one mounting leg configured to be press-fit within at least one receiving well on the second inner surface;

wherein the first opening and the second opening are configured for oppositional alignment in the chassis; and wherein the first elastomeric film and the second elastomeric film are configured to retain a display object in a region defined by an oppositional alignment of the first opening and the second opening.

2. The display device of claim 1 wherein the chassis is configured to pivot between an open position and a closed position, such that the first opening and the second opening are brought into substantial alignment in the closed position.

3. The display device of claim 2 wherein a first portion of the chassis comprises a locking member configured to releasably engage with a second portion of the chassis, such that in the closed position, the first mounting member and the second mounting member are retained in opposition to one another.

4. A method of displaying an object comprising: inserting an object between the first and second elastomeric films of the display device of claim 2; and closing the chassis, such that the object is retained in the region defined by the alignment of the first opening and the second opening.

5. The display device claim 3 wherein the locking member is provided along a side edge of the chassis that is configured for opening and closing.

6. The display device of claim 1 further comprising a frame, wherein the frame comprises an opening configured to receive at least a portion of the chassis therein.

7. The display device of claim 6 wherein the chassis is pivotally supported within the frame.

8. The display device of claim 7 wherein the chassis is pivotable longitudinally within the frame.

9. The display device of claim 6 wherein the opening of the frame is substantially rectangular in shape.

10. The display device of claim 6 wherein both the chassis and the opening of the frame are substantially rectangular in shape.

11. The display device of claim 10 wherein the first opening and the second opening independently comprise a regular or irregular geometric shape, and wherein the regular geometric shape is independently selected from the group consisting of rectangular, oval, square, triangular, circular, and combinations thereof.

12. The display device of claim 10 wherein a geometric shape of the first opening is complementary to a geometric shape of the second opening.

13. The display device of claim 1 wherein the first elastomeric film and the second elastomeric film are comprised of a polymeric material.

14. The display device of claim 13 wherein the polymeric material is substantially transparent.

15. The display device of claim 13 wherein the polymeric material is selected from the group consisting of polyethylene, polyurethane, and a combination thereof.

16. The display device of claim 13 wherein the polymeric material comprises polyurethane.

17. The display device of claim 1 wherein the display object is substantially two-dimensional.

18. The display device of claim 1 wherein the display object is substantially three-dimensional.

19. The display device of claim 1 wherein at least one depression is formed on each of the first and second inner surfaces of the chassis in order to provide access to the mounting members for removal.

20. The display device of claim 1 wherein at ridge is formed on each of the first and second inner surfaces of the chassis in order to conceal the mounting members.

21. A display device comprising:

a first mounting member comprising a first film-mounting surface, wherein the first film-mounting surface demarcates a first opening in the first mounting member;

a second mounting member comprising a second film-mounting surface, wherein the second film-mounting surface demarcates a second opening in the second mounting member;

a first elastomeric film mounted to the first film-mounting surface and extending across the first opening; a second elastomeric film mounted to the second film-mounting surface and extending across the second opening; and a chassis configured for supporting the first mounting member and the second mounting member on opposing first and second inner surfaces of the chassis, the first mounting member includes at least one mounting leg configured to be press-fit within at least one receiving well on the first inner surface and the second mounting member includes at least one mounting leg configured to be press-fit within at least one receiving well on the second inner surface, the chassis further configured to pivot between an open position and a closed position;

wherein each of the first and second elastomeric films comprises polyurethane; wherein the first opening and the second opening are configured to be in substantial alignment when the first mounting member and the second mounting member are supported in the chassis and the chassis is in the closed position; and wherein the first elastomeric film and the second elastomeric film are configured to stretch to conform to a three-dimensional shape of a display object retained in a region defined by the alignment of the first opening and the second opening when the first mounting member and the second mounting member are supported in the chassis.

22. The display device of claim 21 wherein a side of the chassis configured for opening and closing comprises a locking member on a first edge thereof, and wherein the locking member is configured for releasable engagement with a second edge of the chassis.

23. A method of displaying an object comprising: inserting an object between the first and second elastomeric films of the display device of claim 22 when the chassis is in the open position; closing the chassis, such that the object is retained in the region defined by the alignment of the first opening and the second opening; and engaging the locking member on the first edge of the chassis with the second edge of the chassis, such that the chassis is releasably locked in the closed position.

24. The display device of claim 21 further comprising a frame comprising an opening configured to pivotally support the chassis therein.

25. A method of displaying an object comprising: inserting an object between the first and second elastomeric films of the display device of claim 21 when the chassis is in the open position; and closing the chassis, such that the object is retained in the region defined by the alignment of the first opening and the second opening.

* * * * *